United States Patent [19]

Lowe, Jr.

[11] 4,008,763

[45] Feb. 22, 1977

[54] WELL TREATMENT METHOD

[75] Inventor: Clovis Carroll Lowe, Jr., Lafayette, La.

[73] Assignee: Atlantic Richfield Company, Los Angeles, Calif.

[22] Filed: May 20, 1976

[21] Appl. No.: 688,274

[52] U.S. Cl. ..... 166/253; 166/278

[51] Int. Cl.[2] ..... E21B 47/10

[58] Field of Search ..... 166/250, 253, 276, 278; 73/153

[56] References Cited

UNITED STATES PATENTS

| | | | |
|---|---|---|---|
| 2,007,465 | 7/1935 | Burt | 166/253 X |
| 2,183,654 | 12/1939 | Moore | 166/250 |
| 2,451,520 | 10/1948 | Teplitz | 166/253 |
| 2,660,887 | 12/1953 | Frei | 166/253 X |
| 3,031,571 | 4/1962 | Fearon | 73/153 X |
| 3,173,293 | 3/1965 | Eckels | 166/253 X |
| 3,796,883 | 3/1974 | Smith et al. | 166/278 X |

*Primary Examiner*—Stephen J. Novosad
*Assistant Examiner*—George A. Suchfield
*Attorney, Agent, or Firm*—Roderick W. MacDonald

[57] ABSTRACT

A method wherein a plurality of solid particle packs, often called gravel packs, are emplaced in a wellbore to prevent production of solids from formations into the wellbore, the improvement comprising incorporating in each pack a tracer material which is unique to that particular pack. Thereafter, fluid produced from the well can be analyzed at the earth's surface to determine if any and, if so, which pack is leaking solid particles into the well. Subsequent workover of the well can then be limited to the pack or packs indicated to be leaking rather than being directed to all packs in the well.

7 Claims, 2 Drawing Figures

WELL TREATMENT METHOD

BACKGROUND OF THE INVENTION

In a number of areas of the world such as the Gulf Coast of the United States, there are geologic formations or zones through which a wellbore penetrates when drilling a well, such as an oil and gas well, which formations or zones contain solid particles that are not strongly held in place. These particles, e.g., fine grained sand, tend to flow into the wellbore as fluids such as oil and/or gas flow from the interior of the formations into the wellbore.

The pumping of a large number of small solid particles through the producing equipment of a well can in some situations cause increased wear and tear on that equipment. Therefore, it is desirable to prevent the production of substantial amounts of solid particles into the wellbore.

One procedure devised to prevent solids production from a well is generically called gravel packing. This procedure involves placing a liner, screen, or other perforated cylindrical device in the area of the wellbore where solid particles are naturally produced from the formation into the wellbore. In the annulus between the outside of the liner and the wellbore wall (face of the formation which is producing solid particles into the wellbore) a particulate material such as sand, not necessarily gravel as the generic term used in the industry implies, is emplaced to act as a filter to keep the finer grained solids produced from the formation from passing through the perforations in the liner and into the wellbore itself.

After forming the pack there is left in the wellbore in the vicinity of the producing formation a liner backed by a pack of solid particles which are sufficiently large so as to bridge or otherwise not pass through the apertures in the liner. The pack particles are sufficiently close packed to filter out finer solid particles being produced from the formation itself without impeding the flow of oil and gas through the pack and liner and into the wellbore for production to the earth's surface. Thus, gravel packs are, in effect, and in situ filtering device so that solid particles entrained in the oil and gas are filtered from it before the oil and gas reaches the interior of the wellbore for production to the earth's surface.

Oftentimes a wellbore has a plurality, i.e. two or more, of packs emplaced therein. This can be necessary because the producing formation is sufficiently thick that a satisfactory pack over the full thickness of the formation requires the emplacement of a series of packs or because more than one formation is producing into the wellbore, or because the producing formation is perforated or otherwise has apertures such as fractures therein which are desirably packed first (referred to in the industry as a pre-pack). In accordance with this invention the term "pack" is intended to cover all packs emplaced in the wellbore itself and all pre-packs which extend into apertures in a formation.

When a plurality of packs are employed in a single wellbore sometimes one pack will leak solids into the wellbore while another pack will not. When it is discovered that, after all packing procedures are completed, the well is still producing solids, it is impossible to know at the earth's surface which pack is not working as desired. Accordingly, it is highly desirable to be able to pin-point the pack or packs which are continuing to leak solid particles into the wellbore so that a workover job can be directed to these particular packs and the others ignored thereby substantially reducing workover costs and rig time necessary to get the well into the desired condition of not producing any substantial amount of solids to the earth's surface.

SUMMARY OF THE INVENTION

According to this invention, when a packing method is employed in a well utilizing a plurality of packs, a tracer material is employed in each pack, the tracer material being unique to that particular pack. Thereafter, upon production of fluid from the well, the produced fluid can be analyzed at the earth's surface to determine if any, and if so which, pack or packs are leaking solid particles into the wellbore. This way upon workover of the well the workover can be directed precisely to the leaking packs and the other packs in the well can be ignored with confidence.

Accordingly, it is an object of this invention to provide a new and improved method for gravel packing a well. It is another object to provide a new and improved method for minimizing workover requirements when carrying out a packing method on a well. It is another object to provide a new and improved method for determining what packs in a well require workover.

Other aspects, objects and advantages of this invention will be apparent to those skilled in the art from this disclosure and the appended claims.

DETAILED DESCRIPTION OF THE INVENTION

Figure 1:
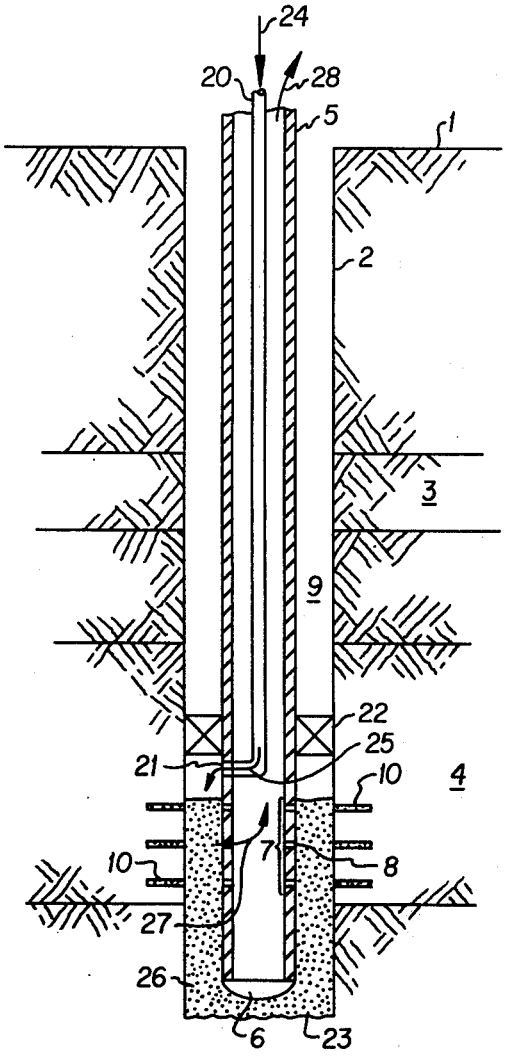
FIG. 1 shows a cross section of a wellbore penetrating two producing formations in the earth.

More specifically, FIG. 1 shows the earth's surface 1 having a wellbore 2 extending therein, the wellbore passing through producing formations or zones 3 and 4. Communication from the earth's surface to the interior of the wellbore and, therefore, with zones 3 and 4 is provided by casing 5.

In the particular situation of FIG. 1, formation 4 is to be considered as being of a thickness sufficiently great that a plurality of packs is necessary to adequately cover the full thickness of that formation with a gravel pack that is sufficiently consolidated to filter out fines produced from the interior of formation 4 before they reach the interior of casing 5. Thus, casing 5 is closed at its lower end 6 and perforated over a first lower interval 7 so that a plurality of apertures 8 extend through the wall of casing 5 to provide fluid communication between the interior of casing 5 and annulus 9 between the outer surface of casing 5 and wellbore face 2.

Formation 4 has been perforated, as shown by open passages 10 extending thereinto. Openings 10 are candidates for a pre-packing process wherein pack solids are actually forced back into the apertures before the wellbore pack is emplaced in annulus 9.

As shown in FIG. 1, only the lower half of formation 4 has been perforated so that only the lower half will be packed first after which the upper half will be packed so that in essence two packs will be employed to cover formation 4.

In forming the first or lower pack of formation 4, tubing 20 is run down through the center of casing 5 and connected to existing aperture 21 so that fluid communication is established between the earth's surface and annulus 9 below packoff 22 by way of the interior of tubing 20 and aperture 21. Thus, a closed annulus is formed between pack-off 22 and bottom 23 of the wellbore. Accordingly, when a gravel pack fluid is introduced at the earth's surface into tubing 20 as shown by arrow 24 the gravel pack fluid, e.g., particulate solids such as sand in a carrier liquid such as water, passes down tubing 20, through aperture 21 as shown by arrow 25, and into annulus 9 below pack-off 22. In the pre-pack stage apertures 8 would effectively be closed by a pack-off (not shown) in the interior of casing 5 below aperture 21 so that the pressurized pack fluid would flow into apertures 10 and deposit the solid materials carried thereby in the apertures themselves. After prepacking apertures 10, the wellbore pack is emplaced following the same procedure except that casing 5 is opened so that the pack solids are deposited in annulus 9, as shown by 26, by allowing the carrier fluid to escape from closed annulus 9 through apertures 8 as shown by arrow 27. The escaped fluid then passes upwardly within casing 5 but outside of tubing 20 back to the earth's surface for recovery as shown by arrow 28.

After completion of the pre-pack an packing processes there is left in the wellbore, in the lower half of formation 4, packed apertures 10 and an annulus pack 26 so that when oil and gas or other produced fluids which flow from the interior of formation 4 into apertures 10 and through pack 26 and apertures 8 into the interior of casing 5, the solids that would normally be carried by these produced fluids are filtered out in apertures 10 and pack 26. The produced fluids which reach the interior of casing 5 have had entrained solids filtered out so that only relatively solids free fluids are produced from the bottom of the well to the earth's surface.

Figure 2:
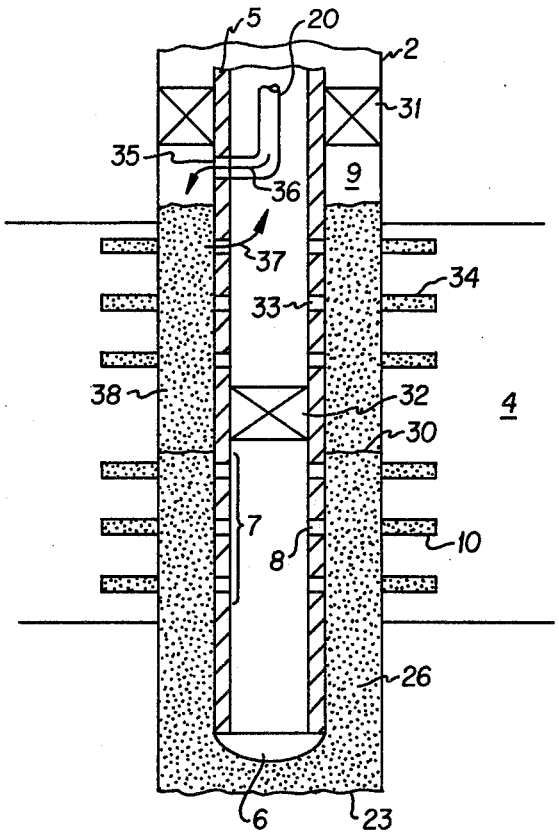
FIG. 2 shows a cross section of the wellbore of FIG. 1 wherein a second of two packs is being emplaced.

The procedure for packing the lower half of formation 4 can then be repeated for the upper half of formation 4 as shown in FIG. 2.

In FIG. 2 the upper portion of the wellbore above formation 4 is eliminated because it will be identical to that shown in FIG. 1. In FIG. 2 the upper end of first pack 26 is shown at line 30, this being the demarcation line where the first or lower pack stops and the upper or second pack starts. When emplacing the upper pack, a pack-off is employed in annulus 9 as shown by 31 and another pack-off is employed in the interior of casing 5 as shown by 32. Aperture 21 is closed. For this second pack, new apertures 33 are formed through casing 5 and new apertures 34 are formed in the formation itself. A pre-pack is emplaced in apertures 34 followed by a wellbore pack in annulus 9 above line 30 and below packoff 31 using tubing 20. This time tubing 20 is connected to a new aperture 35 so that pack fluid can pass therethrough from the interior of tubing 20 as shown by arrow 36. The carrier fluid from the pack is retrieved through apertures 33 as shown by arrow 37 for recovery at the earth's surface as described hereinabove with respect to the pack fluid recovered through apertures 8 as shown by arrow 27.

Thus, by the use of two pre-packs and two wellbore packs the apertures in formation 4 and the full face of formation 4 along wellbore 2 have been packed. Should one or more of these four packs fail adequately to filter solids out of the produced fluids, thereby allowing undesirable levels of solids to enter the interior of casing 5, workover is necessary to plug or otherwise reduce the permeability of the leaking pack or packs to reduce the production of solids to the desired extent. In such a situation it is desirable to know definitely whether it is the pre-pack in apertures 10, lower pack 26, the pre-pack in apertures 34, or upper pack 38, or any combination of two or more of these packs, that is leaking so that the workover job can be directed solely to the leaking packs. Without a means of distinguishing between solid particles from each of the four packs in formation 4 it is impossible to know at the earth's surface which pack is leaking.

In accordance with this invention a tracer material which is unique to each pack is incorporated with that pack so that it can be determined to a certainty which pack or packs are leaking. The pre-pack in apertures 10 will have a traeer material unique only to that pre-pack while the pre-pack in apertures 34 will have another tracer material unique to it and different from that in the pre-pack in apertures 10. Similarly, first and second packs 26 and 38 will each contain a tracer material which is unique to each of those packs and different from the pre-packs. This way, should only pack 26 leak solids, only the tracer material unique to that pack will show up at the earth's surface and on subsequent workover only pack 26 will be treated.

Sometimes two or more formations are producing into the same wellbore. This is shown in FIG. 1 by formation 3 which is spaced upwardly and apart from formation 4. Sometimes, even when all formations are sufficiently thin that a single pack will cover each formation, it is desirable to put a pack on each formation of the wellbore. Thus, if formation 4 had been sufficiently thin so that a single pack would cover its full thickness, a separate pack could still have been employed in the same wellbore to cover the thickness of formation 3 so that the wellbore would still have two separate packs therein. Consequently, a need for tracer material in each separate pack would exist so that should one pack leak it can be identified with certainty.

The tracer material employed in this invention can be anything that can be differentiated from the other materials, including other tracer materials, used in the same wellbore. The tracer material can be solid, liquid, gaseous or any combination thereof so long as it marks solid particles in the pack in which it is incorporated so that should solid particles be produced from that particular pack it can be determined at the earth's surface precisely which pack is inadequate. It is preferable that the tracer materials used in a given well be visually differentiable from one another so the determination of which pack, if any, needs retreatment, can be made on the well site. For example, tracer materials composed of solid particles which are differently colored can be incorporated in each pack emplaced in a single well.

It is not required, however, that the tracer materials be subject to differentiation only by visual inspection. Tracer materials can also be differentiated by chemical analysis, spectographic analysis, X-ray analysis, radioactive analysis, and so on, it being only required that the various tracer materials used in a particular well be differentiable from one another should they be produced back to the earth's surface. The tracer material should not be of a character such that they would mask one another should two or more thereof be produced back to the earth's surface at the same time, but rather must be distinguishable from one another when mixed because, as mentioned before, two or more packs can be leaking into the wellbore at the same time.

When the tracer material is composed of solid particles, the particles can be of any composition, size, particle size grading, and the like so long as the tracer material does not interfere with the desired results of the pack, the ability of the well to produce fluids, the ability of the pack to filter solids from the produced fluids, and the like. For example, the particulate tracer material could be sand, plastic beads, glass beads, and the like of various colors and can be used in widely varying amounts depending on the particular requirements of the well, and the pack or packs employed therein; how much must be used to be able, by visual inspection at the earth's surface, to determine if those particles are being produced back to the earth's surface; and the like.

The amount of tracer material employed will vary widely but generally is that which is sufficient to allow detection at the earth's surface should a small amount thereof be produced back into the wellbore. Generally, when the tracer material is employed as solid particles during the packing treatment, a major amount of the tracer material can be used to replace the pack solids normally used in such a treatment.

EXAMPLE

A well having a cross section essentially the same as that shown in FIG. 1 contains a single thick formation 4 which is not perforated. Red particulate tracer material is employed in forming lower pack 26 and blue particulate tracer material is employed in forming upper pack 38, the amount of the tracer material employed in each pack comprising about 50% by weight of the solids normally employed in each pack. The colored particles employed in each of packs 26 and 38 are PYREX beads having the size range of 0.015 inches to 0.030 inches.

Thereafter, the well is put on production at the desired rate and the produced fluid periodically analyzed visually to determine if either or both of the colored particles are being produced back to the earth's surface.

The embodiments of the invention in which an exclusive property or privilege is claimed are defined as follows:

1. In a gravel packing method in a well wherein a plurality of packs are emplaced, the improvement comprising incorporating in each pack a tracer material which is unique to that particular pack, and analyzing fluid thereafter produced from said well to determine if any and if so which pack is leaking solid particles into said well.

2. The method of claim 1 wherein said tracer materials can be differentiated by visual inspection.

3. The method of claim 2 wherein the tracer material is solid particles, and different colored particles are incorporated in each pack.

4. The method of claim 1 wherein said tracer material can be differentiated by chemical analysis.

5. The method of claim 1 wherein said tracer material can be differentiated by spectrographic analysis.

6. The method of claim 1 wherein said tracer material can be differentiated by X-ray analysis.

7. The method of claim 1 wherein said tracer material is incorporated in packs that extend into a formation as well as packs that do not leave the wellbore so that upon analysis at the earth's surface it can be determined if it is a formation pack or a wellbore pack that is leaking solids into the wellbore.

* * * * *